US007596907B2

(12) United States Patent
Hüge et al.

(10) Patent No.: US 7,596,907 B2
(45) Date of Patent: Oct. 6, 2009

(54) FORCE TRANSMISSION ELEMENT, WINDOW LIFTER AND MOTOR VEHICLE DOOR WITH A WINDOW LIFTER

(75) Inventors: Carsten Hüge, Wehretal (DE); Claus Mangold, Helsa (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 0 days.

(21) Appl. No.: 11/994,455

(22) PCT Filed: Jul. 4, 2006

(86) PCT No.: PCT/EP2006/063857

§ 371 (c)(1),
(2), (4) Date: Feb. 12, 2008

(87) PCT Pub. No.: WO2007/014822

PCT Pub. Date: Feb. 8, 2007

(65) Prior Publication Data

US 2008/0202031 A1 Aug. 28, 2008

(30) Foreign Application Priority Data

Aug. 4, 2005 (DE) ..... 10 2005 037 324

(51) Int. Cl.
*E05F 11/48* (2006.01)

(52) U.S. Cl. ..... 49/352; 49/348; 49/349; 49/502

(58) Field of Classification Search ..... 49/352, 49/348, 349, 502
See application file for complete search history.

(56) References Cited

U.S. PATENT DOCUMENTS 3,014,716 A * 12/1961 Hitzelberger ..... 49/70
4,199,899 A * 4/1980 Muhling et al. ..... 49/352
4,835,907 A * 6/1989 Heuchert ..... 49/352
5,009,035 A * 4/1991 Kuki et al. ..... 49/352

(Continued)

FOREIGN PATENT DOCUMENTS

DE 196 19 087 11/1997

(Continued)

OTHER PUBLICATIONS

English Translation of International Preliminary Report on Patentability for PCT/EP2006/063857.

(Continued)

*Primary Examiner*—Katherine W Mitchell
*Assistant Examiner*—Jeff Tang
(74) *Attorney, Agent, or Firm*—Martin Fleit; Paul D. Bianco; Fleit Gibbons Gutman Bongini & Bianco PL

(57) ABSTRACT

The invention relates to a force-transmission element for a window lifter (200; 300; 500) for transmitting a closing force (242; 342, 356) and an opening force (230; 330, 350) to a window (210; 310; 510), wherein the force-transmission element has a first force application point (216; 316, 316'; 416) for transmitting the closing force and a second force application point (222; 322, 322'; 422) for transmitting the opening force, and wherein the force application points are arranged in a displacement direction of the window and offset perpendicular to this displacement direction.

17 Claims, 7 Drawing Sheets

U.S. PATENT DOCUMENTS

| | | | | |
|---|---|---|---|---|
| 5,309,679 | A | 5/1994 | Ward | |
| 6,053,271 | A * | 4/2000 | Lee | 180/282 |
| 6,115,966 | A * | 9/2000 | Shibata | 49/352 |
| 6,510,657 | B1 * | 1/2003 | Bertolini et al. | 49/502 |
| 2003/0140562 | A1 * | 7/2003 | Staser et al. | 49/352 |
| 2004/0144032 | A1 * | 7/2004 | Smith | 49/352 |
| 2005/0011130 | A1 * | 1/2005 | Klippert et al. | 49/352 |
| 2006/0059781 | A1 * | 3/2006 | Berklich et al. | 49/352 |
| 2007/0017159 | A1 * | 1/2007 | Moore | 49/502 |
| 2007/0044382 | A1 * | 3/2007 | Moriyama et al. | 49/352 |
| 2007/0130835 | A1 * | 6/2007 | Isomura et al. | 49/352 |
| 2007/0180773 | A1 * | 8/2007 | Fortin et al. | 49/352 |

FOREIGN PATENT DOCUMENTS

| | | | |
|---|---|---|---|
| DE | 197 23 642 | | 12/1997 |
| DE | 202 02 352 | U1 | 5/2002 |
| DE | 102 30 073 | | 7/2002 |
| DE | 102 52 055 | | 11/2002 |
| DE | 102 55 461 | | 11/2002 |
| EP | 1 129 875 | | 9/2001 |
| FR | 2 831 588 | A | 5/2003 |
| JP | 09 189170 | A | 7/1997 |
| WO | WO 2004/002766 | | 1/2004 |
| WO | WO 2004/065738 | | 8/2004 |

OTHER PUBLICATIONS

English Translation of the Written Opinion of the International Search Authority for PCT/EP2006/063857.

International Search Report for PCT/EP2006/063857.

* cited by examiner

FORCE TRANSMISSION ELEMENT, WINDOW LIFTER AND MOTOR VEHICLE DOOR WITH A WINDOW LIFTER

FIELD OF THE INVENTION

The invention relates to a force-transmission element for a window lifter and also to a window lifter and to a motor-vehicle door with a window lifter.

BACKGROUND OF THE INVENTION

Various window lifters are known from the state of the art, like those from, for example, DE 197 23 642 B4, DE 102 30 073 A1, EP 1 129 875 B1, WO 2004/002766 A1, DE 196 19 087 C2, DE 102 52 055A1, WO 2004/065738 A1, and DE 102 55 461 A1.

A common disadvantage of previously known window lifters is that the maximum so-called glass drop, that is, the maximum travel of the window between a closed position and an open position, is smaller than the spacing of the deflection rollers of the window lifter. This is clarified in FIG. 1 as an example for a window lifter known from the state of the art:

FIG. 1 shows a cable window lifter 100, which is fixed to a support panel 102 of a motor-vehicle door. The support panel 102 involves the inside door panel of the motor-vehicle door or a support plate of a door module.

The cable window lifter 100 has a drive motor 104, which is fixed to the support panel 102. The single cable 106 of the cable window lifter 100 is guided by means of two deflection rollers 108 and 110 and is connected to a catch 114 with the help of a cable fitting 112 squeezed with the cable 106. The catch 114 engages in a displaceable way, on one side, with a guide rail 116 extending along the displacement direction of the windowpane not shown in FIG. 1 and supports, on the other side, the windowpane. Through rotation of the cable reel of the drive motor 104 to the right or to the left, the catch 114 is shifted upwards or downwards along the guide rail 116, by means of which the windowpane can open and close.

In FIG. 1, the catch 114 is shown with dashed lines in position A, that is, in the closed position of the window, and also in position B, that is, in the maximum open position of the window. The resulting maximum travel 118 of the window, that is, the so-called glass drop, is considerably smaller, as a principle, than the spacing 120 of the deflection rollers 108 and 110.

Consequently, the invention is based on the task of creating an improved force-transmission element for a window lifter, a window lifter, and a motor-vehicle door with a window lifter.

The problems forming the basis of the invention are each solved with features of independent claims. Preferred embodiments of the invention are specified in the dependent claims.

SUMMARY OF THE INVENTION

Through the invention, a force-transmission element for a window lifter is created for transmitting a closing force and an opening force onto a window, wherein the force-transmission element has a first force application point for transmitting the closing force and a second force application point for transmitting the opening force, and wherein the force application points are arranged in a displacement direction of the window and offset perpendicular to this displacement direction.

Due to the offset arrangement of the force application points for the opening force and the closing force in the vertical and horizontal directions, with the help of the force-transmission element according to the invention, a window lifter can be created, in which the maximum travel of the window is greater than the spacing of the deflection rollers. Therefore, an especially compact construction of the window lifter can be realized.

According to one embodiment of the invention, the force-transmission element has an attachment means for attaching to the window. The attachment means can be constructed for forming a positive or non-positive connection to the window.

According to one embodiment of the invention, the force-transmission element has a first projection for forming the first force application point and a second projection for forming the second force application point, wherein the projections point in different directions, preferably in essentially opposite horizontal directions. Here, the first projection is arranged above the second projection.

According to one embodiment of the invention, the first projection has a first stop surface for forming a first stop in an open position of the window and the second projection has a second stop surface for forming a second stop in a closed position of the window. Preferably, the stop surfaces have a circular arc-shaped construction, in order to form stops with deflection rollers of the window lifter.

According to one embodiment of the invention, the force application points are each used for receiving one traction cable. Through a spring, at least one of the traction cables can be set under a bias tension, which can increase the service life of the window lifter with gradual expansion of the traction cable.

In another aspect, the invention relates to a window lifter with at least one force-transmission element according to the invention. The window lifter has a drive for transmitting a first traction force to the first force application point for opening the window and for transmitting a second traction force to the second force application point for closing the window.

According to one embodiment of the invention, corresponding first and second traction cables for transmitting the traction forces are driven by the drive by means of at least one cable reel.

According to one embodiment of the invention, a first deflection roller is used for deflecting the first traction force and a second deflection roller is used for deflecting the second traction force, wherein the spacing of the deflection rollers is smaller in the displacement direction than the maximum travel of the window.

According to one embodiment of the invention, the glass connection of the window lifter is realized by means of at least two of the force-transmission elements according to the invention. The two force-transmission elements are mechanically coupled here, so that when the window opens and closes, a traction force is transmitted from one force-transmission element to the other. This mechanical coupling is realized preferably by means of another cable, which is guided by means of another deflection roller.

This embodiment is especially suitable for the realization of a so-called rail-less window lifter, which requires no additional guide rails.

In another aspect, the invention relates to a motor-vehicle door with a window lifter according to the invention. For example, an inside door panel of the motor-vehicle door has an opening which is used for receiving a support on which the drive and the deflection rollers of the window lifter are mounted. Because an especially compact construction of the window lifter is possible due to the force-transmission elements according to the invention, that is, the arrangement of deflection rollers with a relatively small spacing, the opening in the inside door panel can be relatively small accordingly. In this way, the stiffness of the motor-vehicle door and also the crash safety can be increased.

BRIEF DESCRIPTION OF THE DRAWINGS

In addition, preferred embodiments of the invention will be explained in more detail with reference to the drawings. Shown are.

DETAILED DESCRIPTION OF THE INVENTION

Figure 1:
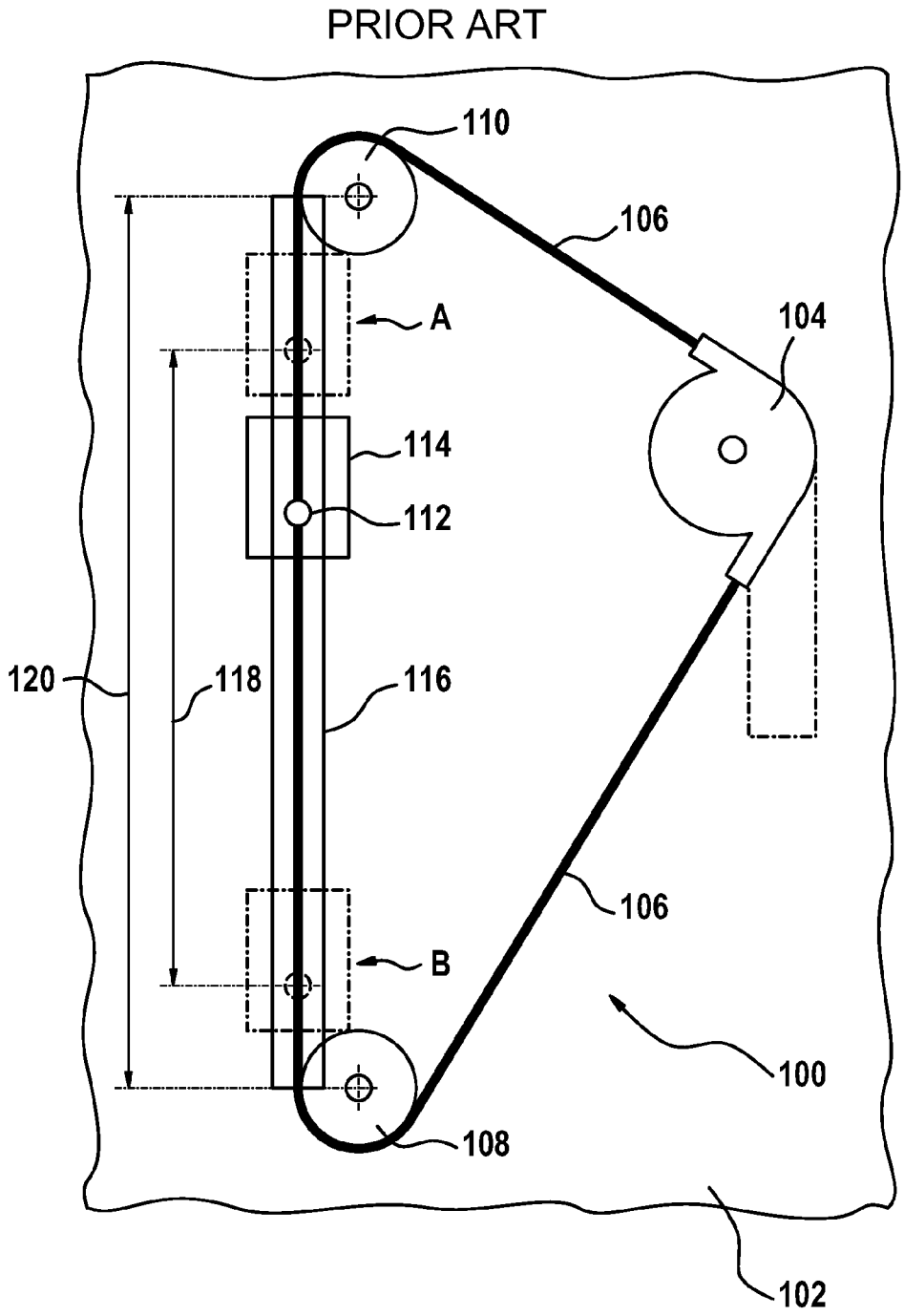
FIG. 1 a cable window lifter known from the state of the art.
Figure 2:
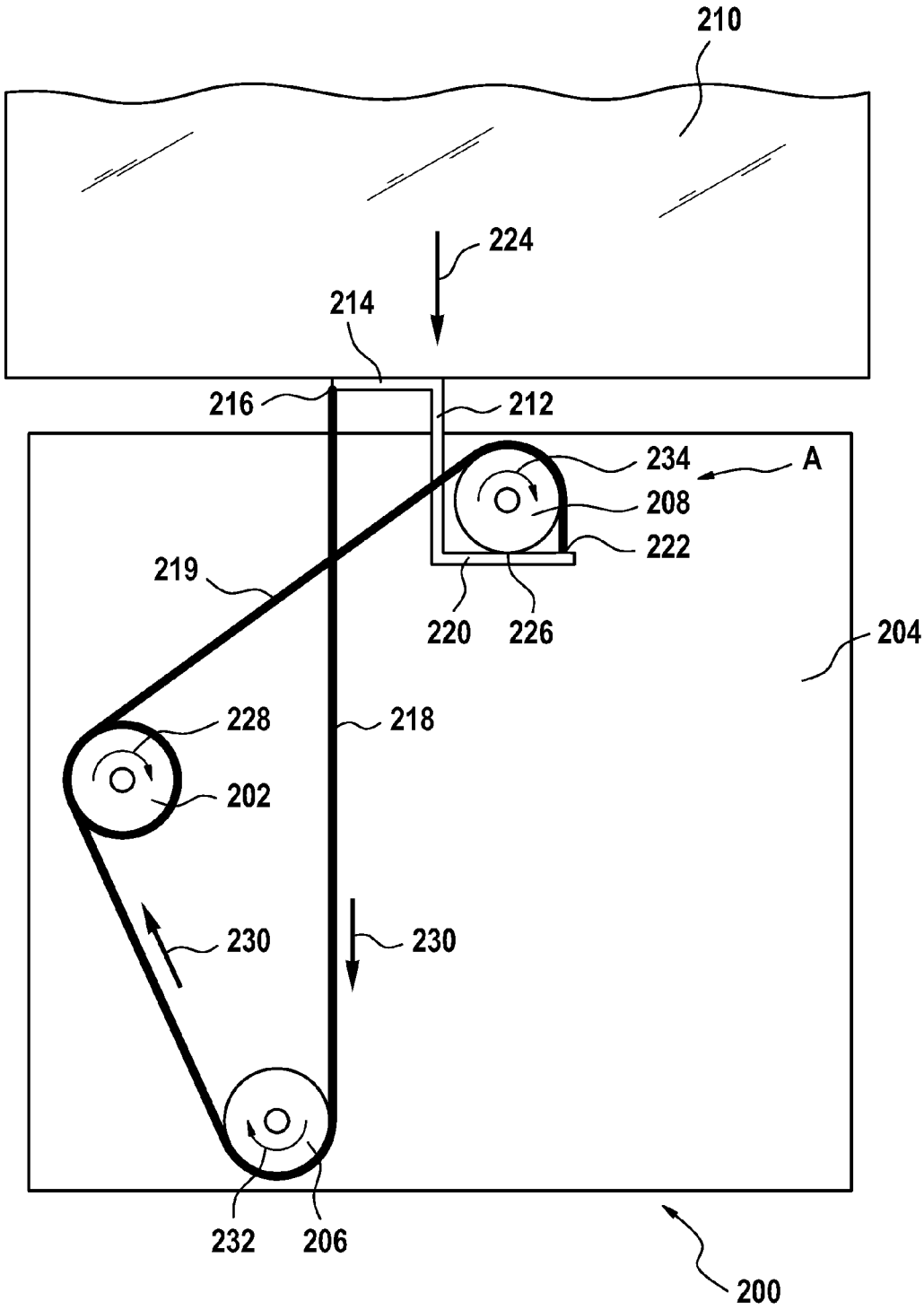
FIG. 2 a first embodiment of a window lifter according to the invention in a closed position of the window, FIG. 3 the embodiment of the window lifter of FIG. 2 in an open position of the window, FIG. 4 a second embodiment of a window lifter according to the invention in a closed position of the window, FIG. 5 the embodiment of the window lifter of FIG. 4 in an open position of the window, FIG. 6 a perspective representation of an embodiment of a force-transmission element for the glass connection of the window lifter, FIG. 7 a detail view of the force-transmission element of FIG. 6, FIG. 8 the inside door panel of a motor-vehicle door, with a third embodiment of a window lifter according to the invention.

FIG. 2 shows a cable window lifter 200. The cable window lifter 200 has a drive, which drives a cable reel 202. The drive with its cable reel 202 is mounted on a support 204. The support 204 can involve a support panel such as an inside door panel, for example, or a plastic support, which, for example, is screwed to an inside door panel. The plastic support can form a so-called door module.

Furthermore, on the support 204 there are a lower deflection roller 206 and an upper deflection roller 208.

A window 210, which is to be displaced with the help of the cable window lifter 200, is shown in FIG. 2 in a completely closed position. The window 210 is connected rigidly to a force-transmission element 212. The force-transmission element 212 has an upper projection 214 with a force-application point 216 for a traction cable 218. The cable 218 is connected rigidly to the projection 214 at the force-application point 216.

The force-transmission element 212 has another projection 220, on which another force-application point 222 is formed. In the embodiment considered here, the projections 214 and 220 point in essentially opposite directions which are each essentially perpendicular to the displacement direction 224 of the window 210.

In the closed position of the window 210 shown in FIG. 2, the top side of the projection 220 forms stop 226 with the deflection roller 208, by means of which the upward movement of the window 210 is limited.

The force-application point 222 of the force-transmission element 212 is connected to another cable 219. The cable 219 is guided by means of the deflection roller 208 to the cable reel 202.

In the closed position of the window 210 shown in FIG. 2, the maximum length of the cable 218 is unwound from the cable reel 202, while a maximum length of the cable 219 is wound onto the cable reel 202.

Instead of a single cable reel 202, there can also be two separate cable reels for the cables 218 and 219, which are driven by the same drive.

For opening the window 210, the drive propels the cable reel 202 in the directional sense 228 shown in FIG. 2. In this way, a traction force 230 is transmitted at the force-application point 216 via the cable 218. Because the force-application element 212 is connected rigidly to the window 210, the force 230 acts on the window 210 in the displacement direction 224, so that the window 210 is set in motion in the displacement direction 224. In this way, the deflection roller 206 begins to rotate in the directional sense 232.

Simultaneously, the cable 219 is unwound from the cable reel 202, so that the deflection roller 208 can rotate in the directional sense 234. In this way, the force-transmission element 212 moves from its position A shown in FIG. 2 into its position B shown in FIG. 3, in which the window 210 is completely open. The position A of the force-transmission element 212 is also shown with dashed lines in FIG. 3.

In the position B, a maximum length of the cable 218 has been wound onto the cable reel 202, while a maximum length of the cable 219 has been unwound from the cable reel 202. In this position, the window 210 is opened to its maximum extent. In the position B, the projection 214 is located at the height of the lower deflection roller 206.

By moving the force-transmission element 212 from position A to position B, a travel 236 of the glass pane 210 has been realized, which is greater than the spacing 238 of the deflection rollers 206 and 208. This allows the support 204 to have a correspondingly compact construction.

For closing the window 210 in the displacement direction 224, the cable reel 202 is driven in the directional sense 240 opposite the directional sense 228. In this way, a force 242 is transmitted via the cable 219 at the force-application point 222. Because the force-transmission element 212 is connected rigidly to the window 210, the force 242 also acts on the window 210, so that it is set in motion in the displacement direction 224. Due to these circumstances, the deflection roller 208 rotates in the directional sense 244 opposite the directional sense 234.

By rotating the cable reel 202 in the directional sense 240, the cable 218 is further unwound, so that the deflection roller 206 rotates together with the window 210 in the displacement direction 224 in the directional sense 245 opposite the directional sense 232 due to the movement of the force-transmission element 212. For closing the window 210, the maximum length of the cable 218 is unwound from the cable reel 202 until the force-transmission element 212 has again reached its position A.

According to another embodiment, the deflection rollers 206 and the projection 214 can be arranged so that the bottom side of the projection 214 forms a stop with the deflection roller 206 in position B, by means of which the end position is clearly defined for opening the window 210.

Figure 3:
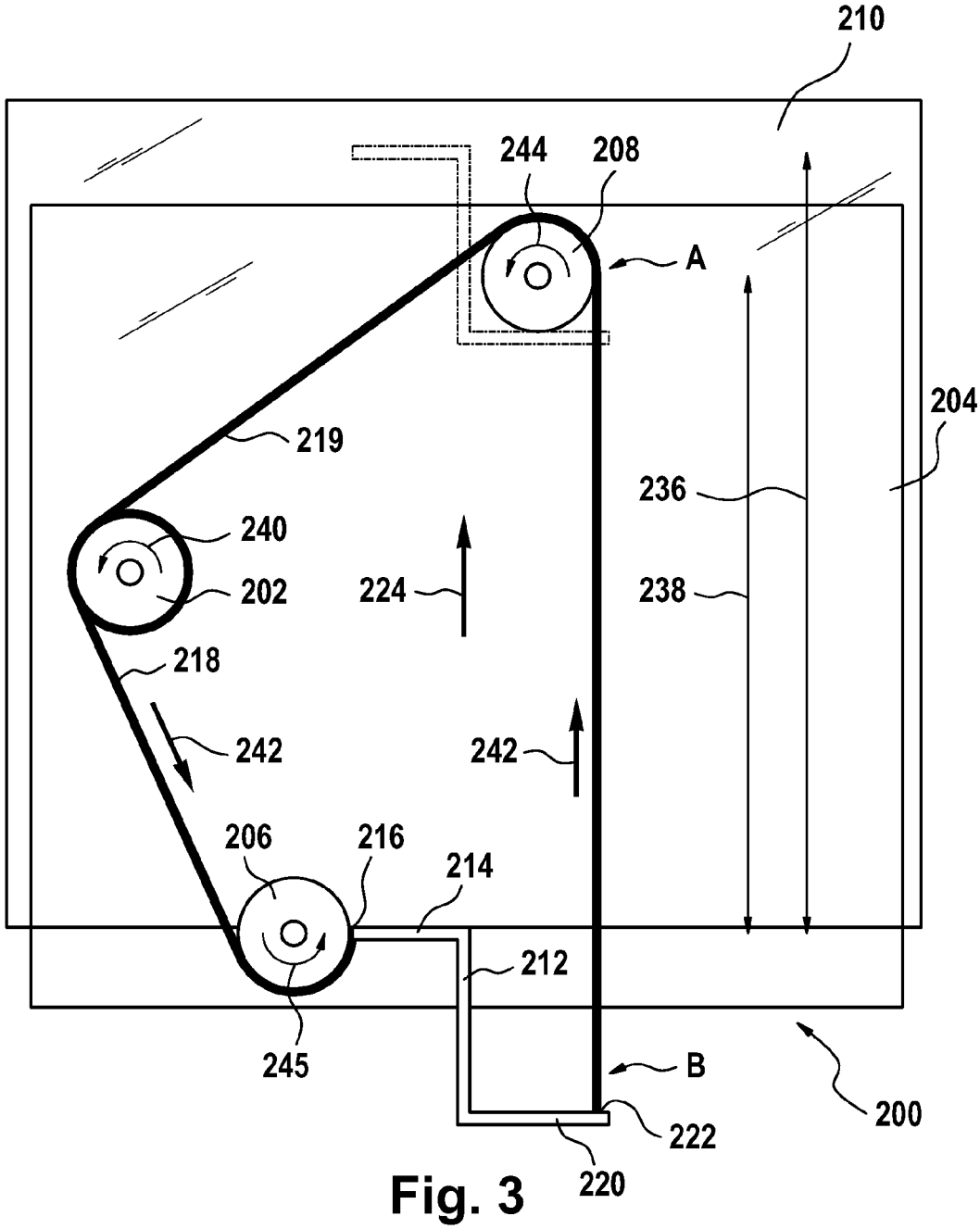
Figure 4:
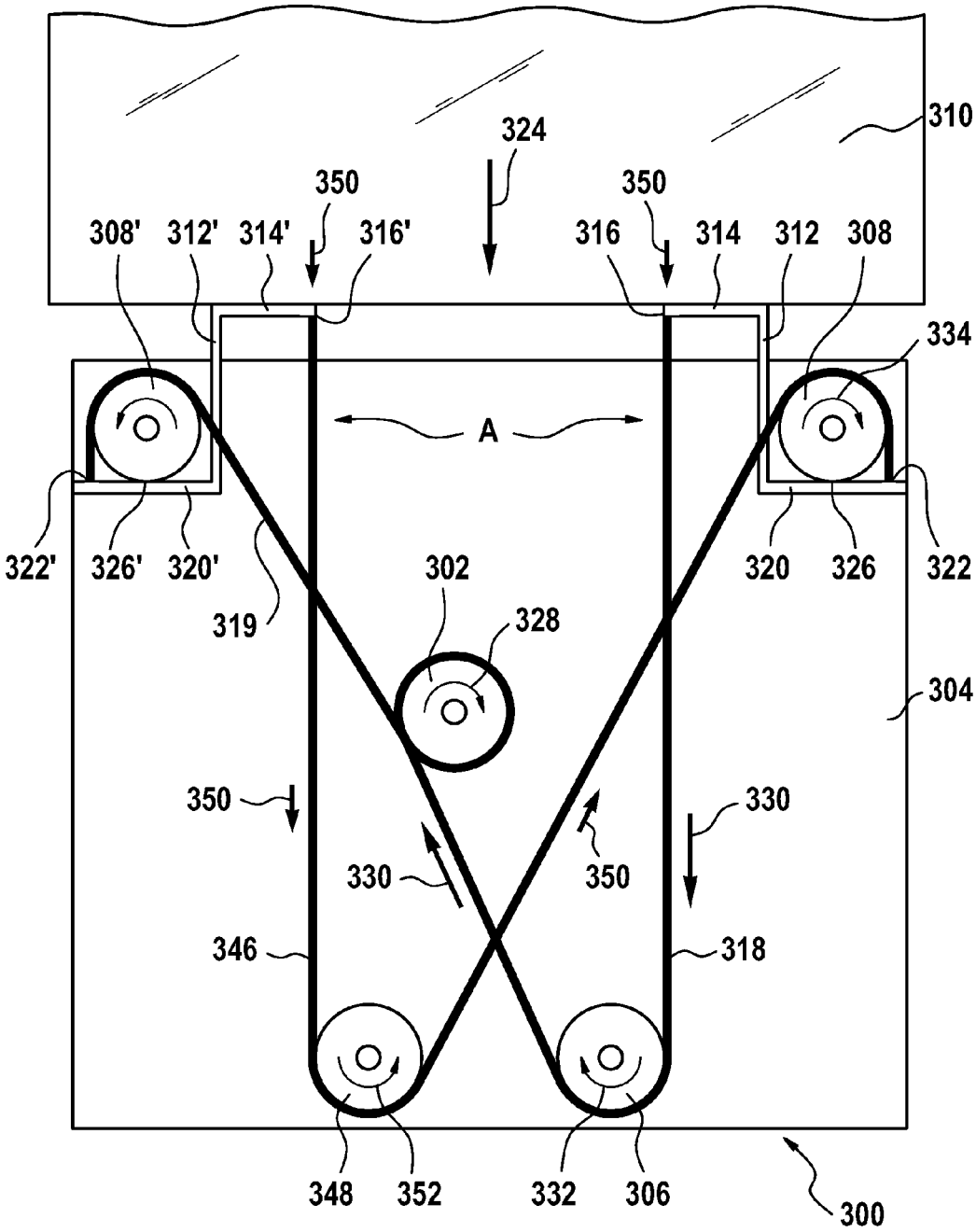

FIG. 4 shows another embodiment of a cable window lifter according to the invention. Elements of FIG. 4 that correspond to elements of FIGS. 2 and 3 are designated with corresponding reference symbols.

In the embodiment of the cable window lifter 300 according to FIG. 4, two of the force-transmission elements 312 and 312' are connected rigidly to the window 310. As in the embodiment of FIGS. 2 and 3, the cable 318 is connected to the force-application point 316 of the projection 314 and guided by means of the deflection roller 306 to the cable reel 302. Likewise, the cable 319 is guided at the force-application point 322' of the projection 320' by means of the upper deflection roller 308'. When the cable reel 302 is driven in the directional sense 328, the cable 318 is wound onto the cable reel, so that the force 330 acts on the force-application point 316.

In contrast to the embodiment of FIGS. 2 and 3, the force-application point 322 is not connected to the cable reel 302, but instead to the force-application point 316' of the force-transmission element 312' by means of another cable 346, which is guided by means of a deflection roller 348. Thus, a force 350 is transmitted from the force-application point 322 to the force-application point 316' by means of the cable 346, wherein, for a symmetric arrangement, the force 350 is approximately half as large as the force 330. In this way, the two force-transmission elements 312, 312' each transmit approximately the force 350 to the window 310. This embodiment is especially advantageous for realizing a window lifter that does not require additional guide rails for the window 310.

For the opening movement of the window 310 in the displacement direction 324, the cable 318 is wound onto the cable reel 302, so that the force 330 is transmitted to the force-application point 316. Simultaneously, the cable 319 is unwound from the cable reel 202.

Furthermore, a part of the force 330 is transmitted from the force-application point 322 via the cable 346 to the force-application point 316', wherein the cable 346 is neither wound nor unwound. The deflection roller 348 here rotates in the directional sense 352, as shown in FIG. 4.

Figure 5:
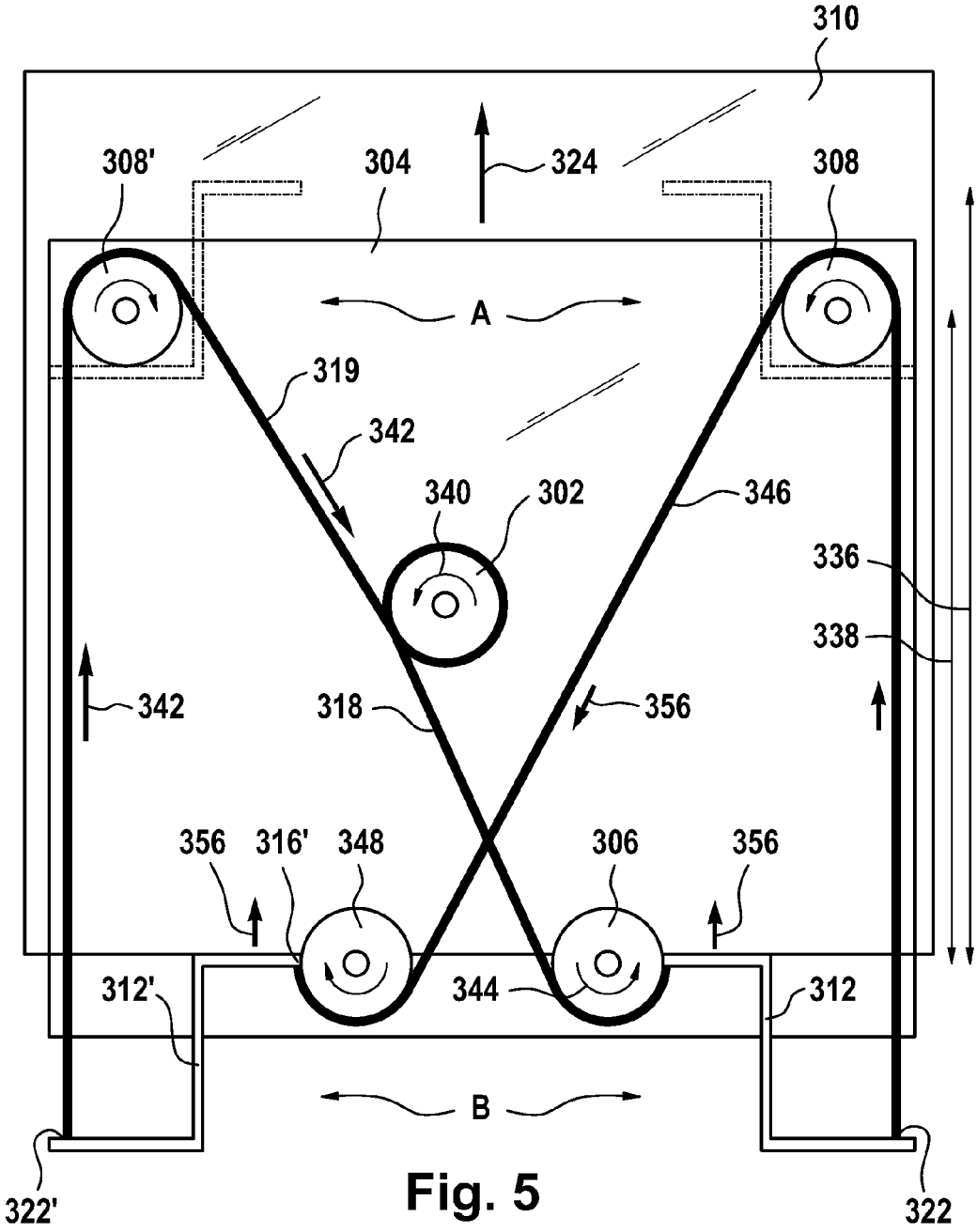

FIG. 5 shows the embodiment of FIG. 4, after the window 310 has been completely opened. Here, the force-transmission elements 312, 312' have moved from position A (shown in FIG. 5 with dashed lines) to position B. The resulting maximum travel 326 of the window 310 is, in turn, greater than the spacing 328 of the deflection rollers 308, 308' or 306, 348.

In position B, the cable 318 is wound to a maximum extent onto the cable reel 302, while a maximum length of the cable 319 is unwound from the cable reel 302. The cable 346 is neither wound nor unwound, but instead connects the force-application points 316' and 322 via the deflection rollers 308 and 348.

For closing the window 310 in the displacement direction 324, the cable reel 302 is driven in the directional sense 340, so that a force 342 is transmitted from the cable 319 to the force-application point 322'. This force 342 is transmitted partially as force 356 from the cable 346 to the force-application point 322. With an approximately symmetric arrangement, the force 356 equals approximately half the force 342, so that the same force 356 is transmitted to both sides of the window 310 by the force-transmission element 312 or 312'. Due to these circumstances, the window 310 or the force-transmission element 312 or 312' is moved back to position A.

Figure 6:
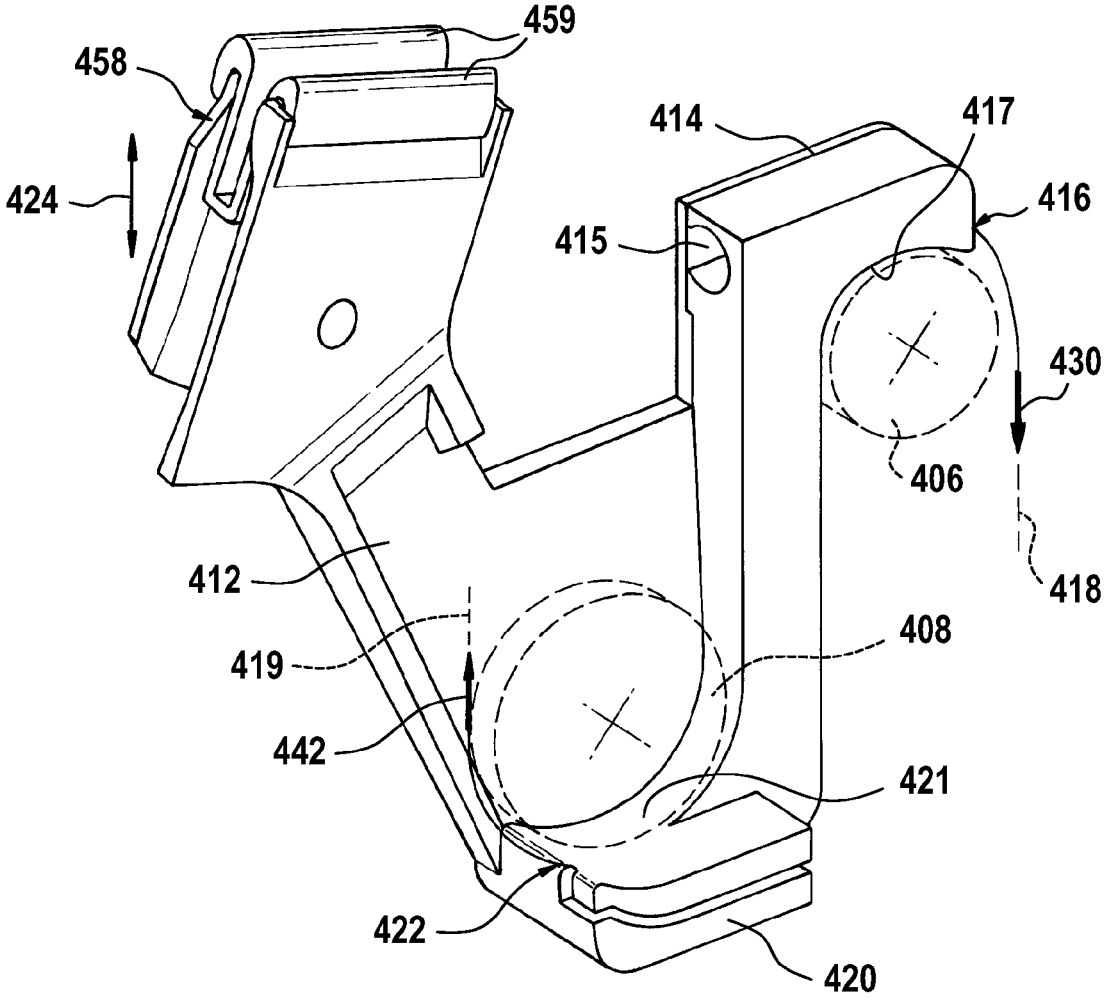

FIG. 6 shows an embodiment of a force-transmission element 412, as it can be used in the embodiments of FIGS. 2 to 5 of the window lifter according to the invention. Elements of FIG. 6 that correspond to elements of FIGS. 2 to 5 are designated with corresponding reference symbols. The force-transmission element 412 has a projection 414 with an opening 415 for receiving a cable 418. A traction force can be introduced via the cable 418 to the force-application point 416, which is formed by the projection 414.

On its bottom side, the projection 414 has a circular arc-curved surface 419 for forming a stop with the deflection roller 406, for example. This stop is formed in the completely opened position of the window, cf. here the position B of FIGS. 3 and 5.

The force-transmission element 412 has another projection 420, at which the cable 419 is attached. A traction force 442 can be exerted via the cable 419 to the force-application point 422 formed by the projection 420.

The projections 420 and 414 are arranged offset in the displacement direction 424.

The projection 420 has a circular arc-curved surface 421 for forming a stop (cf. stop 226 of FIG. 2) with the deflection roller 408.

The force-transmission element 412 further has an attachment element 458, which is used for the so-called glass connection, that is, the attachment of the force-transmission element 412 to the moving windowpane. The attachment element 458 has, in the embodiment of FIG. 5, two legs 460, which are arranged opposite each other, so that a clamp is formed for the positive and/or non-positive connection to the windowpane.

In the embodiment of FIGS. 4 and 5, a force-transmission element according to the embodiment of FIG. 6 can be used for both force-transmission elements 312 and 312'.

Figure 7:
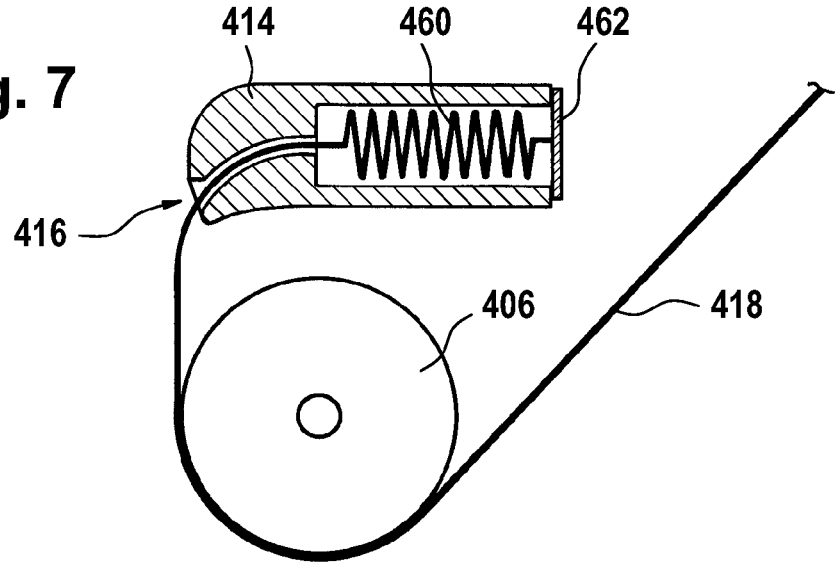

FIG. 7 shows a partial section of the force-transmission element of FIG. 6 through its projection 414. In the embodiment shown here, there is a spring 460 in a pocket hole of the projection 414. One end of the spring 460 is held by an attachment fitting 462, which is supported on the edges of the pocket hole, so that the spring 460, which is connected with its other end to the cable 418, exerts a bias tension on the cable 418. This bias tension has the advantage that with a possible lengthening of the cable 418, which can occur especially after a long operating period, the window lifter remains completely functional.

Figure 8:
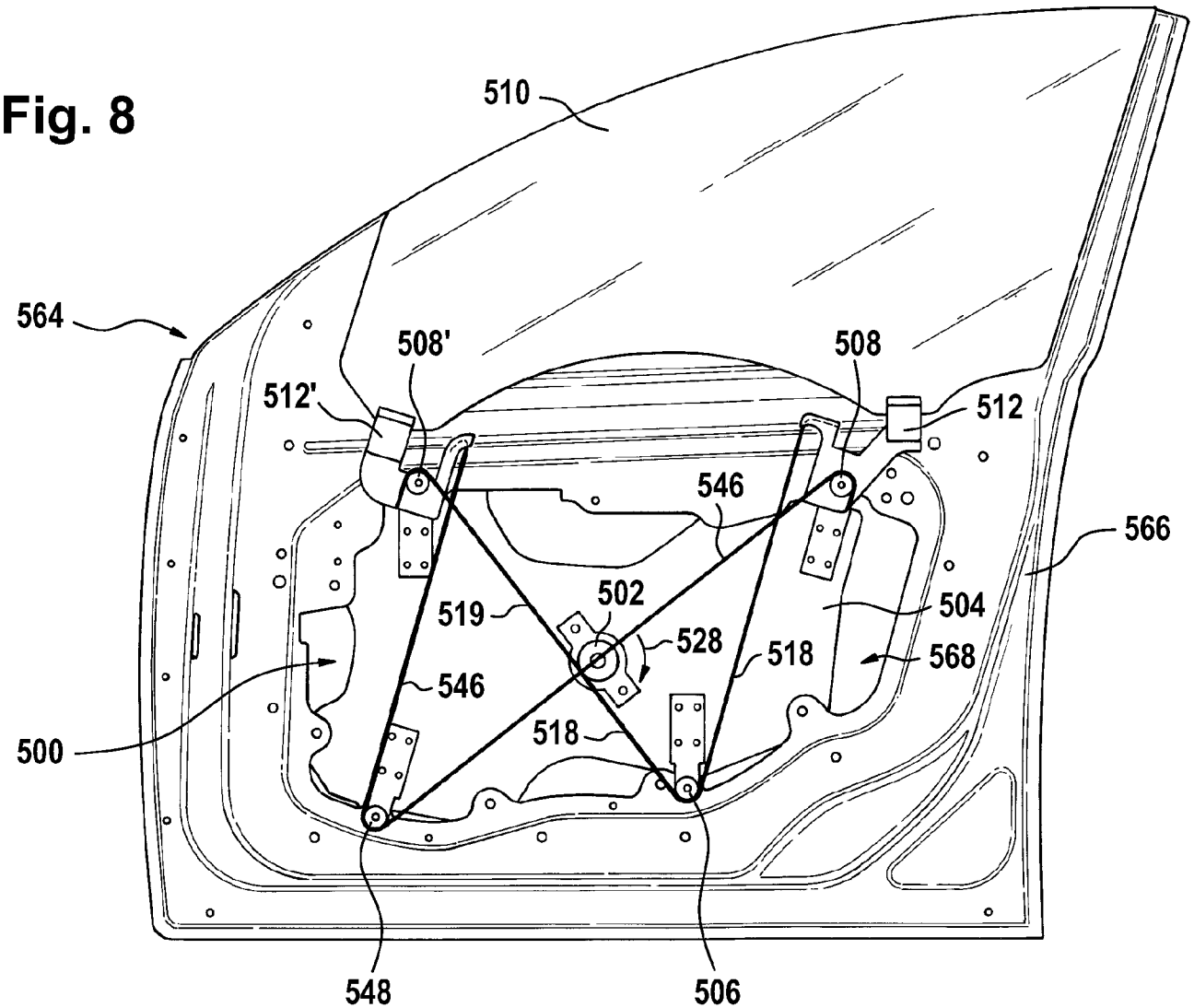

FIG. 8 shows a motor-vehicle door 564. Elements of FIG. 8 that correspond to elements of FIGS. 2 to 6 are designated with corresponding reference symbols.

The motor-vehicle door 564 has an inside door panel 566, which has an opening 568. The support 504 of one embodiment of the cable window lifter 500 according to the invention is attached to the edges of the opening 568. The cable window lifter 500 is constructed as a so-called rail-less window lifter according to the embodiments of FIGS. 4 and 5.

FIG. 8 shows the window 510 in its closed position. For opening the window 510, the cable reel 502 is driven by the propulsion in the directional sense 528, so that the cable 518 transmits a traction force to the force-transmission element 512 and is wound onto the cable reel 502, the cable 519 is unwound from the cable reel 502, and a portion of the traction force transmitted by means of the cable 518 is transmitted via the cable 546 from the force-transmission element 512 to the force-transmission element 512'.

In contrast to the embodiment of FIGS. 4 and 5, the cable 546 crosses the cable reel 502. For example, above the cable reel 502, there is a panel on which the cable 546 can slide.

LIST OF REFERENCE SYMBOLS

100 Cable window lifter
102 Support panel
104 Drive motor
106 Cable
108 Deflection roller
110 Deflection roller
112 Cable fitting
114 Catch
116 Guide rail
118 Travel
120 Spacing
200 Cable window lifter
202 Cable reel
204 Support
206 Deflection roller
208 Deflection roller

210 Window
212 Force-transmission element
214 Projection
216 Force-application point
218 Cable
219 Cable
220 Projection
222 Force-application point
224 Displacement direction
226 Stop
228 Directional sense
230 Force
232 Directional sense
234 Directional sense
236 Travel
238 Spacing
240 Directional sense
242 Force
244 Directional sense
245 Directional sense
300 Cable window lifter
302 Cable reel
304 Support
306 Deflection roller
308 Deflection roller
308' Deflection roller
310 Window
312 Force-transmission element
312' Force-transmission element
314 Projection
314' Projection
316 Force-application point
316' Force-application point
318 Cable
319 Cable
320 Projection
320' Projection
322 Force-application point
322' Force-application point
324 Displacement direction
326 Stop
326' Stop
328 Directional sense
330 Force
334 Directional sense
336 Travel
338 Spacing
340 Directional sense
342 Force
344 Directional sense
346 Cable
348 Deflection roller
350 Force
352 Directional sense
356 Force
412 Force-transmission element
414 Projection
415 Opening
416 Force-application point
418 Cable
419 Surface
420 Projection
421 Surface
430 Traction force
458 Attachment element
460 Spring
462 Attachment fitting
500 Cable window lifter
502 Cable reel
504 Support
506 Deflection roller
508 Deflection roller
508' Deflection roller
510 Window
512 Force-transmission element
512' Force-transmission element
518 Cable
519 Cable
528 Directional sense
546 Cable
548 Deflection roller
564 Motor-vehicle door
566 Inside door panel
568 Opening

The invention claimed is:

1. Force-transmission element, of a window lifter for transmitting a closing force and an opening force to a window, comprising:

a first projection for forming a first force-application point for transmitting the closing force, said first projection having a first stop surface for forming a first stop in an open position of the window; and a second projection for forming a second force-application point for transmitting the opening force, said second projection having a second stop surface for forming a second stop in a closed position of the window;

the force-application points being offset in a displacement direction of the window and offset perpendicular to the displacement direction;

said first projection extending in a first direction laterally from the displacement direction and said second projection extending a second direction laterally from the displacement direction and opposite of the first direction; and said first projection being disposed above said second projection;

wherein the first and/or second stop surfaces have a circular-arc surface abutting a deflection roller when said force transmission element reaches a top or bottom of a displacement path.

2. Force-transmission element according to claim 1, with an attachment means for attachment to the window.

3. Force-transmission element according to claim 2, wherein the attachment means is constructed for forming a positive or non-positive connection to the window.

4. Force-transmission element according to claim 1, wherein the first force-application point is constructed for receiving a first cable and the second application point is constructed for receiving a second cable.

5. Window lifter with at least one force-transmission element according to claim 1 and a drive for transmitting an opening force to the first force-application point for opening the window and for transmitting a closing force to the second force-application point for closing the window.

6. Window lifter according to claim 5, with a first cable for introducing the opening force and a second cable for introducing the closing force, and at least one cable reel for the first and second cables.

7. Window lifter according to claim 5, with a first deflection roller for deflecting the opening force and a second deflection roller for deflecting the closing force, wherein the spacing of the deflection rollers in a displacement direction of the window is smaller than the maximum travel of the window.

8. Window lifter according to claim 5, with first and second force-transmission elements, wherein the first force-application point of the second force-transmission element is coupled mechanically to the second force-application point of the first force-transmission element.

9. Window lifter according to claim 8, wherein the mechanical coupling is realized by a third cable guided by means of a third deflection roller.

10. Window lifter according to claim 8, wherein the mechanical coupling is constructed so that when the window is opened, a traction force is transmitted from the second force-application point of the first force-transmission element to the first force-application point of the second force-transmission element.

11. Window lifter according to claim 5, with a support for the drive and the deflection rollers.

12. Window lifter according to claim 11, wherein the support for receiving is constructed in an opening of an inside door panel.

13. Motor-vehicle door with a window lifter according to claim 5.

14. Motor-vehicle door according to claim 13 with an inside door panel, which has an opening for receiving a support of the window lifter.

15. A cable window lifter for lifting a window along a displacement direction to positions higher and lower than respective deflection roller axes, comprising:

a lower deflection roller;

an upper deflection roller;

a cable being passed under said lower deflection roller and over upper deflection roller and being movable along said lower deflection roller and said upper deflection roller;

a force transmission element extending along the displacement direction;

an upper projection extending laterally from said force transmission element, said upper projection being connected to said cable along a length of said cable running from beneath said lower deflection roller;

a lower projection extending laterally from said force transmission element, said lower projection being connected to said cable along a length of said cable running from over said upper deflection roller.

16. The cable window lifter according to claim 15, wherein:

said upper deflection roller has an axis;

said lower deflection roller has an axis;

said upper projection connects to said cable above said axis of said upper deflection roller when said force transmission element is in an uppermost position; and said lower projection connects to said cable below said axis of said lower deflection roller when said force transmission element is in a lowermost position.

17. The cable window lifter according to claim 15, wherein said lower projection abuts said upper deflection roller when the window in an uppermost position.

* * * * *